US008210972B2

(12) United States Patent
Adams et al.

(10) Patent No.: US 8,210,972 B2
(45) **Date of Patent: *Jul. 3, 2012**

(54) MAGNETIC EXPANDABLE BROADHEAD

(75) Inventors: Brian J. Adams, Vincennes, IN (US); Jack Bowman, Henderson, KY (US)

(73) Assignee: Bear Archery, Inc., Evansville, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/949,285

(22) Filed: Nov. 18, 2010

(65) Prior Publication Data

US 2011/0130231 A1 Jun. 2, 2011

Related U.S. Application Data

(60) Provisional application No. 61/265,020, filed on Nov. 30, 2009.

(51) Int. Cl.
*F42B 6/08* (2006.01)

(52) U.S. Cl. ..... 473/583

(58) Field of Classification Search ..... 473/583, 473/584

See application file for complete search history.

(56) References Cited

U.S. PATENT DOCUMENTS 5,083,798 A 1/1992 Massey
5,472,213 A 12/1995 Dudley
7,226,375 B1 6/2007 Sanford
7,234,220 B1 6/2007 Grace, Jr.
2009/0111621 A1 4/2009 Mizek
2010/0173734 A1 * 7/2010 Robbins ..... 473/584
2011/0165977 A1 * 7/2011 Adams et al. ..... 473/583

* cited by examiner

*Primary Examiner* — John Ricci

(74) *Attorney, Agent, or Firm* — Woodard, Emhardt, Moriarty, McNett & Henry LLP

(57) ABSTRACT

Magnetic expandable broadhead arrowheads and methods for magnetically holding the blades of broadhead arrowheads in the retracted position are disclosed. Embodiments include deployable cutting blades that are magnetically held in a retracted position during launch and flight and deploy outwardly upon impact with a target. Other embodiments include magnets where the force holding the cutting blades in the retracted position is localized adjacent either the deployable ends or the pivoting ends of the cutting blades. Still other embodiments include magnets adjacent to substantially the entire length of elongated cutting blades while the blades are in the retracted position. Alternate embodiments include elongated cutting blades that extend in a rearward direction when retracted and cutting blades that extend in a forward direction when retracted.

20 Claims, 9 Drawing Sheets

MAGNETIC EXPANDABLE BROADHEAD

This application claims the benefit of U.S. Provisional Patent Application No. 61/265,020, filed Nov. 30, 2009, which is hereby incorporated by reference in its entirety.

FIELD OF THE INVENTION

The present invention relates generally to archery arrows and more particularly pertains to the use of magnetic force to effect expandable blades on broadhead arrowheads attachable to arrow shafts.

BACKGROUND

Certain types of broadhead arrowheads include mechanically expandable blades that are mounted and arranged to deploy outwardly to an extended position when the broadhead impacts against and proceeds to penetrate the surface of a target. When hunting, such a target is preferably the prey. A larger entry opening preferably causes greater damage and faster bleeding of the prey.

Certain mechanical broadheads have blades which are pivotally mounted at their forward ends and where the rearward ends are forced to move outward to a deployed position upon impact. In alternate arrangements, the blades are pivotally mounted at a rearward end and a forward end rotates outward and rearward to a deployed position upon impact. In still further arrangements, the blades may be slidably and pivotally movable from a retracted position to a deployed position upon impact.

Premature expansion of one or more of a broadhead's blades can pose a safety hazard, can negatively effect the flight characteristics of an arrow with such a broadhead and/or can negatively effect the efficiency of the broadhead at injuring and killing the prey. Many mechanical expandable broadheads incorporate a retaining mechanism to minimize the risk of the blades moving from a retracted position to a deployed position at an undesirable or premature time, such as during storage or during flight before impact. In some mechanical broadheads, the retaining mechanism is a retaining ring or strap around an outer edge of the blades, such as a rubber band, which is typically broken upon impact, releasing the blades, but which must be replaced after each use. In other mechanical broadheads, the retaining mechanism includes a notch or detent on an inner edge of each blade which is initially retained in place by a retaining portion such as a notch, shelf or resilient band on the body of the broadhead, yet which allows the blade to disengage and deploy upon impact. Alternate retaining mechanisms can also be employed.

Objects and attendant advantages of this invention will be readily appreciated as the same become more clearly understood by references to the following detailed description when considered in connection with the accompanying drawings in which like reference numerals designate like parts throughout the figures thereof.

SUMMARY

It is an object of certain embodiments to provide a broadhead that uses magnetic attraction force to maintain mechanical cutting blades in a retracted, folded position during arrow flight or at target contact, yet which allows the blades to expand outwardly from the folded position into an extended position upon target contact.

It is an object of certain embodiments to provide a broadhead that uses magnetic force to assist in maintaining the cutting blades in an extended position after they have been deployed.

This summary is provided to introduce a selection of the concepts that are described in further detail in the detailed description and drawings contained herein. This summary is not intended to identify any primary or essential features of the claimed subject matter, nor is it intended to be used as an aid in determining the scope of the appended claims. Each embodiment described herein is not intended to address every object described herein, and each embodiment does not include each feature described. Other forms, embodiments, objects, advantages, benefits, features, and aspects of the present invention will become apparent to one of skill in the art from the detailed description and drawings contained herein.

DETAILED DESCRIPTION OF PREFERRED EMBODIMENTS

Figure 1:
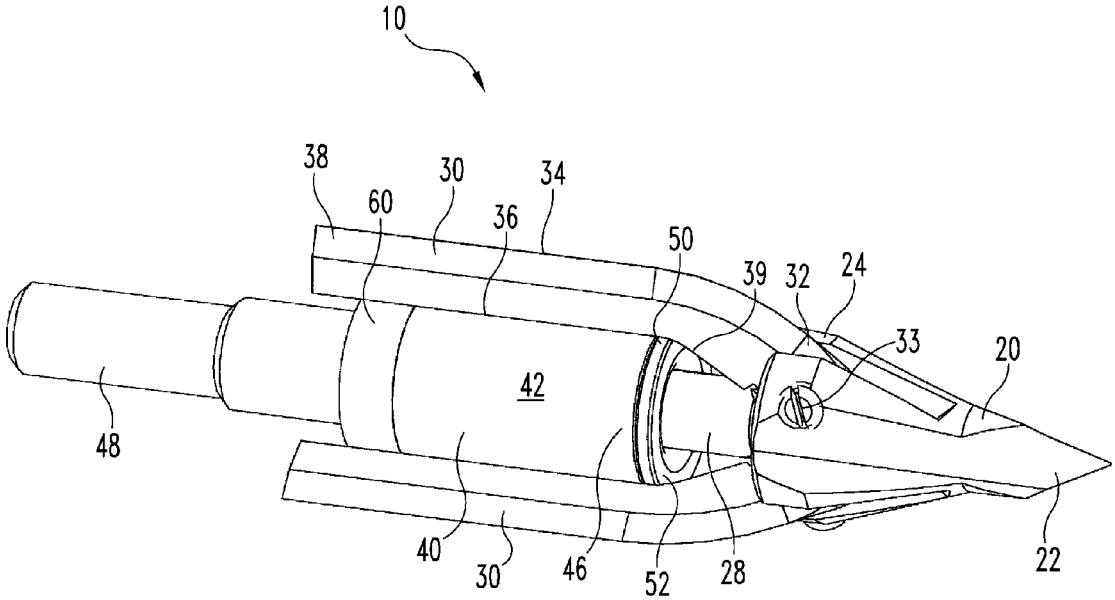
FIG. 1 is a perspective view of a broadhead in a retracted arrangement according to one embodiment of the present disclosure.

For the purposes of promoting an understanding of the principles of the invention, reference will now be made to the selected embodiments illustrated in the drawings and specific language will be used to describe the same. It will nevertheless be understood that no limitation of the scope of the invention is hereby intended, such alterations, modifications, and further applications of the principles of the invention being contemplated as would normally occur to one skilled in the art to which the invention relates. At least one embodiment of the invention is shown in great detail, although it will be apparent to those skilled in the relevant art that some features that are not relevant to the present invention may not be shown for the sake of clarity.

In certain broadheads with one or more mechanically deployable blades, each blade is mounted to a central portion of the broadhead such as to a shaft or body portion. The blades are arranged to lie in a retracted position prior to and during the arrow's flight to decrease the storage size before use, to decrease the risk of damage or injury to the user or blade and to decrease the effect on flight characteristics such as through wind resistance of the broadhead during flight. The blades preferably are arranged to be moved and expanded outward upon impact of the broadhead against a target so that the broadhead with deployed blades creates a larger entry opening in the target.

Various expansion arrangements can be used to allow or force deployment and expansion of the blades upon impact, such arrangements can use principles including momentum, mechanical rotational leverage such as with a bell crank member, camming action, wedging action, piston action or lever action. Example arrangements include those illustrated in U.S. Pat. Nos. 7,226,375; 6,910,979; 6,626,776; 6,554,727; 5,820,498; 5,564,713; 6,935,976; 6,669,586; 6,270,435; 6,200,237; 5,100,143 and U.S. Pub. No. 2008/0045363.

It is an object of certain embodiments herein to use magnetic force in a broadhead with deployable blades to maintain the cutting blades in the retracted or folded state during storage and during arrow flight until impact. In certain embodiments, the blades are preferably formed of a magnetically affected material, typically a ferrous material. One or more magnets are mounted separately or integrally with the broadhead body or shaft and are arranged to apply a magnetic attractive force to the blades. The strength of the magnets is preferably designed to maintain the blades in the retracted position when subjected to forces such as launch, wind and momentum during a flight of the arrow, yet the attractive force can be overcome allowing the mechanical deployment of the blades when additional force is applied to the arrow upon impact.

Certain non-limiting examples of a deployable broadhead incorporating aspects of the disclosure are discussed and illustrated herein, a specific example embodiment is a broadhead based on the broadhead disclosed in U.S. Pat. No. 7,226,375.

Figure 2:
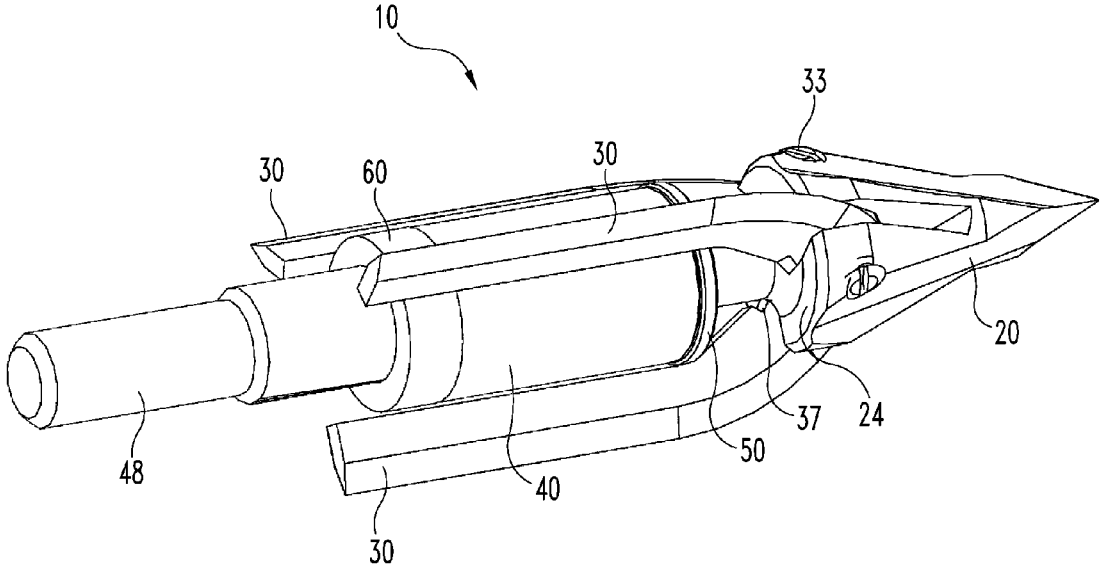
FIG. 2 is an alternate view of the broadhead of FIG. 1.
Figure 3:
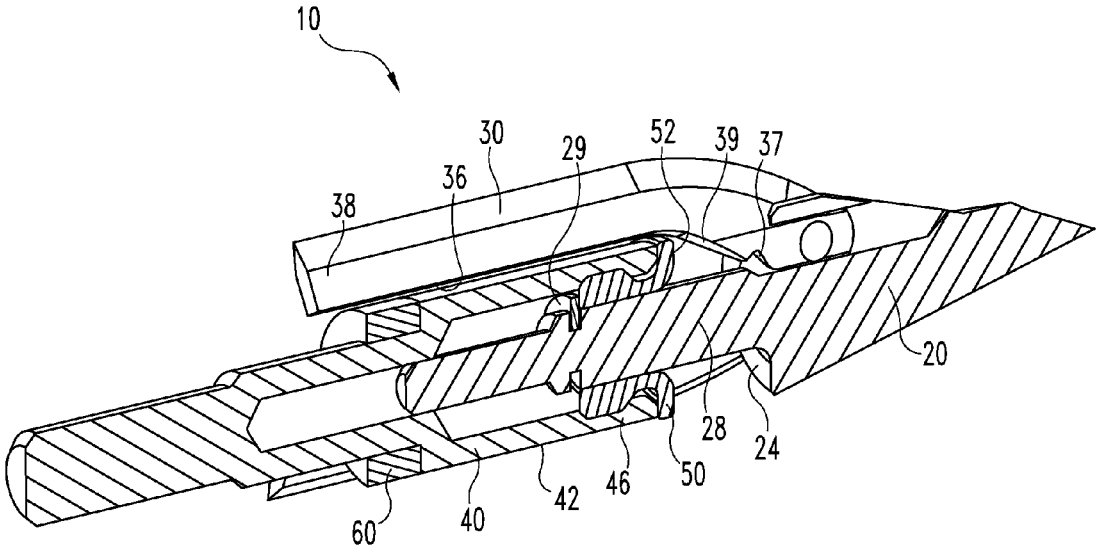
FIG. 3 is a cross-sectional view of the broadhead of FIG. 1.

FIGS. 1 and 2 illustrate perspective views of a broadhead in a retracted arrangement incorporating aspects of the present disclosure. Broadhead 10 is adapted to be mounted to an open end of a hollow arrow shaft. The broadhead 10 includes a tip portion 20 with a forward pointed tip 22 and rearward base 24. A shaft 28 extends rearwardly from base 24. The tip portion 20 is tapered rearwardly and outwardly to rearward base 24.

The pivot ends 32 of two or more cutting blades, for example elongated cutting blades 30, are equally spaced around the circumference of and mounted to base 24. In FIG. 1, two of the cutting blades 30 can be seen. The pivot ends 32 of the cutting blades 30 are attached to grooves in base 24 using pivot pins 33.

One or more magnets are arranged on the broadhead, for example around shaft 28. In one embodiment, a cylindrical magnet forms a sliding shaft housing 40 within which shaft 28 is slidably disposed. Housing 40 is optionally elongated, as depicted in FIGS. 1-6.

Each of the cutting blades 30 includes an outer cutting edge 34 and an inner edge or surface 36. Prior to deployment, the deployable ends (rearward portions 38 in the illustrated embodiment) of the blades 30 are in a retracted position disposed adjacent to and substantially parallel with an outer surface 42 of housing 40. In this embodiment, housing 40 is formed of a magnetic material and applies a radial magnetic attractive force upon blades 30 to urge them to remain in the retracted position. As shown from a different perspective in cross-section in FIG. 3, the inner edge 36 of each blade 30 is characterized by having a forward portion with a beveled cam surface 39.

The sliding shaft 28 is slidably received inside and through an opening in the forward face 52 of hollow collar 50. The collar 50 is threaded into the forward end 46 of sliding shaft housing 40. A rearward end 48 of the sliding shaft housing 40 is attachable to an arrow shaft or arrow shaft insert in the hollow arrow shaft for example using a threaded engagement. A ring or clip 29 fastens to shaft 28 rearwardly of collar 50 and prevents shaft 28 from being extracted from collar 50. Typical hunting arrows include an arrow shaft insert, therefore, the rearward portion 48 can be easily attached to different types of arrows to mount broadhead 10.

In certain embodiments, collar 50 optionally incorporates a magnetic attractive force, for example by being formed from a magnetic material and/or a ring magnet may be formed with or mounted to the forward face 52 of collar 50. Collar 50 may apply a radial magnetic attractive force upon the inner edges 36 of blades 30 to assist in maintaining blades 30 in the retracted position.

As tip 20 impacts a target, the tip 20 is slowed relative to the housing and arrow shaft, allowing the arrow shaft, housing 40 and collar 50 to continue forward, essentially sliding forward along shaft 28 and towards tip 20. During this movement, the beveled cam surfaces 39 of the cutting blades 30 engage the sides of the collar 50. As the collar 50 continues forward relative to the tip 20 and blades 30, the face 52 and edge 53 of collar 50 applies a wedging force against the inner cam surfaces 39 of the blades 30, forcing the cutting blades 30 outwardly into an extended position. Broadhead 10 is shown in a deployed position in FIGS. 4 and 5.

In certain embodiments, forward face 52 of collar 50 may apply a magnetic attractive force towards the rear face of tip base 24. Magnetic attractive force applied to the rear face of tip 20 assists during the deployment movement by pulling the tip towards collar 50, thus assisting in urging the blades 30 outward to the deployed position. After the deployment movement is fully completed, the magnetic attractive force between forward face 52 and tip base 24 resists separation and forward movement of tip 20 relative to housing 40, thus assisting to inhibit unintended retraction of the blades.

Figure 4:
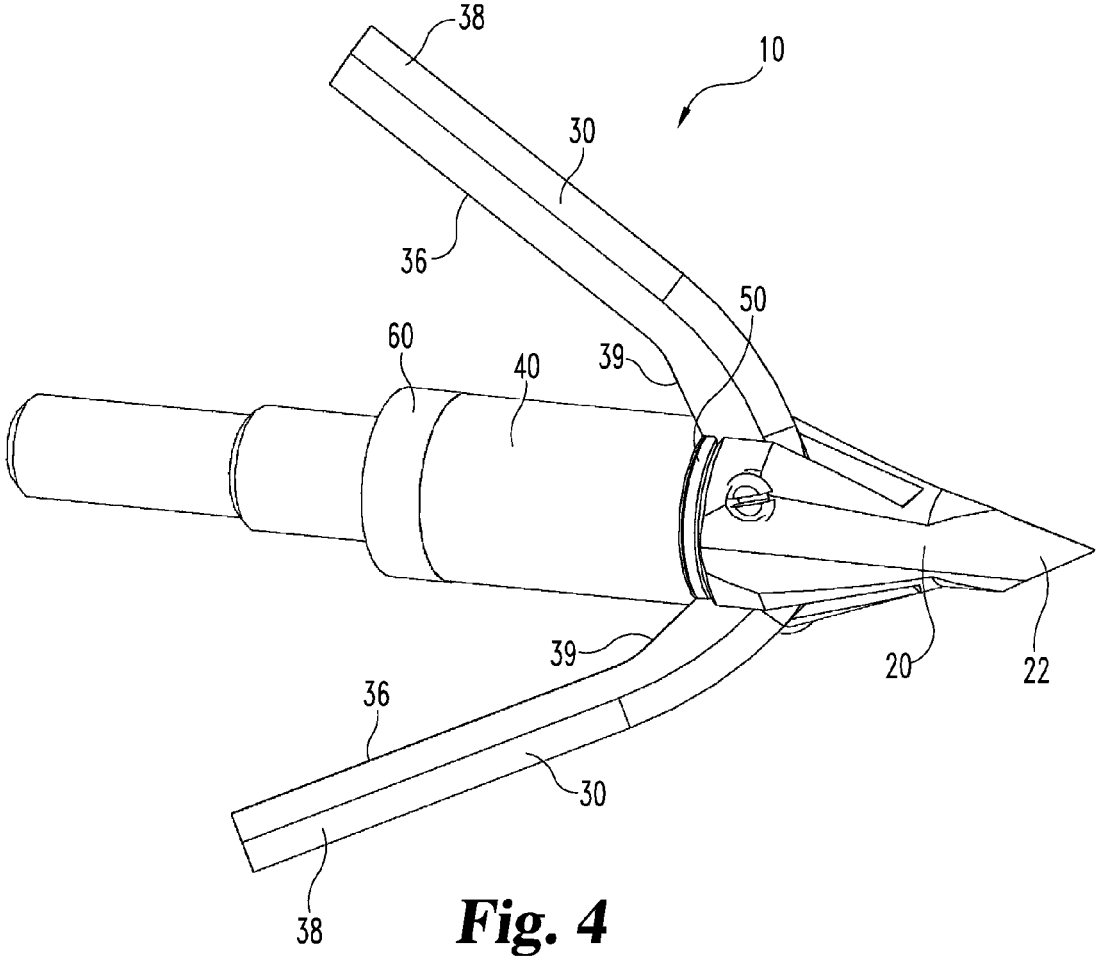
FIG. 4 is a perspective view of the broadhead of FIG. 1 is a deployed arrangement.
Figure 5:
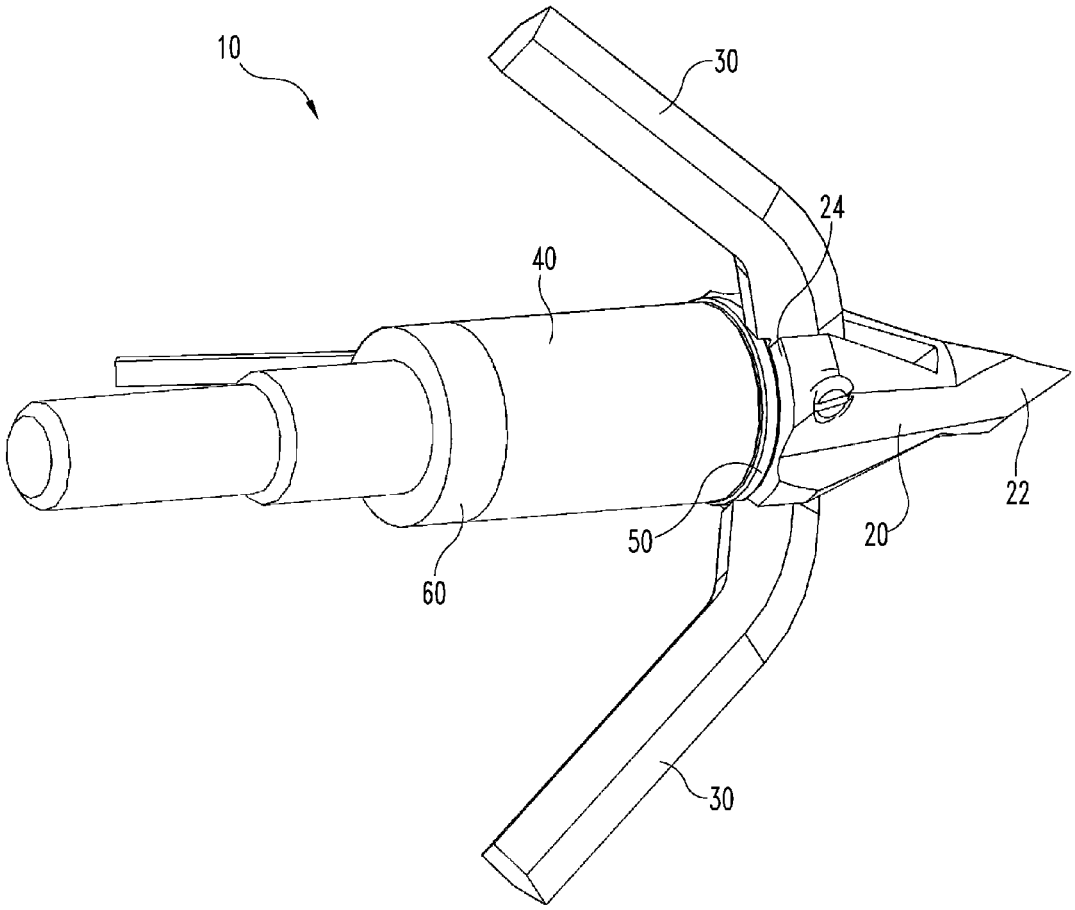
FIG. 5 is an alternate view of the broadhead of FIG. 4.
Figure 6:
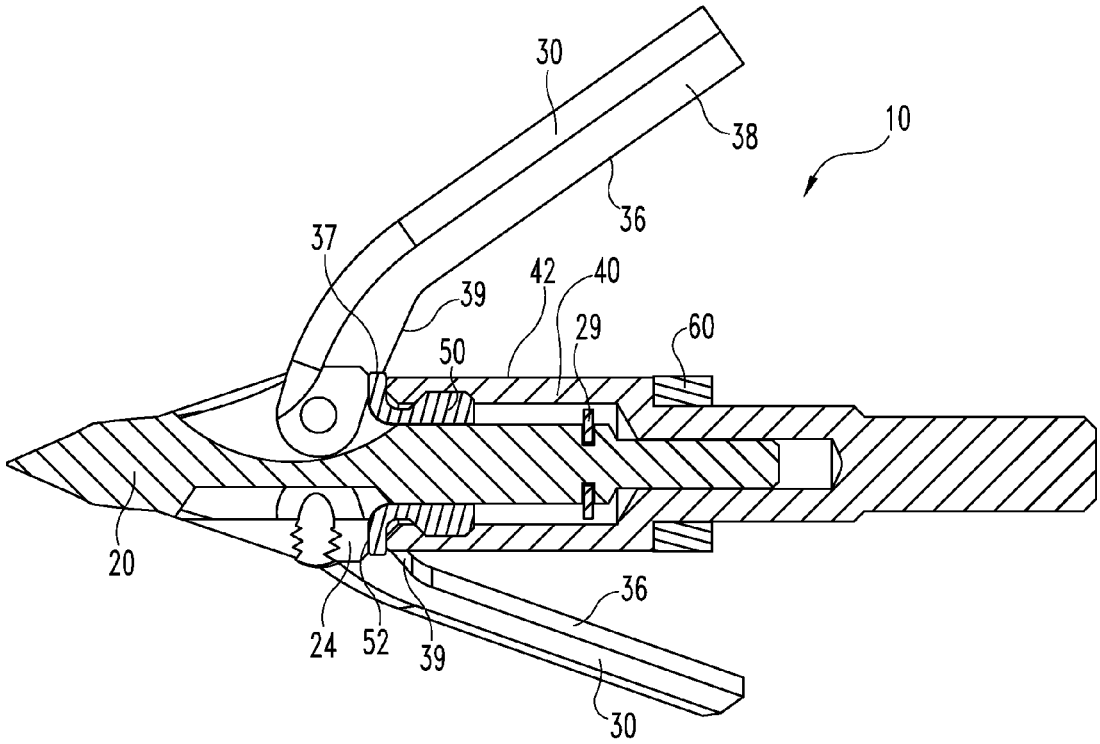
FIG. 6 is a cross-sectional view of the broadhead of FIG. 4.

In the deployed position illustrated in FIGS. 4 and 5, the rearward face of tip 20 is closely adjacent the forward face 52 of collar 50. In embodiments where collar 50 is magnetic, collar 50 is most strongly applying a magnetic attractive force or magnetic lock to tip 20 in this position, assisting to maintain the broadhead in the deployed position. Each blade 30 may also or instead incorporate a notch or shelf 37 forward of cam surface 39, where the notch engages the edge of collar 50 once the blade is deployed beyond a certain position, so that the notch helps lock the blade in the deployed position.

In certain embodiments, a ring magnet 60 is mounted adjacent a rearward portion of sliding shaft housing 40, localizing the magnetic attraction of magnet 60 near the deployable ends of cutting blades 30. Ring magnet 60 may be used in combination with neither, one or both of a magnetic housing and a magnetic collar. A ring magnet may be arranged slightly rearwardly of the housing and/or in a nested area in the housing such that the outer diameter of the ring magnet is substantially equal to the outer diameter of the housing. Alternately, a ring magnet may be disposed around the housing, having an inner diameter which fits the outer diameter of the housing. Optionally, rearward portions of the blades may include a notched area to allow the rearward portions of the blades to form nests to accommodate a ring magnet with a diameter larger than the housing while allowing the remainder of the inner edges to rest next to the housing and collar.

As illustrated, ring magnet 60 preferably applies a magnetic attractive force upon blades 30 to urge them to remain in the retracted position. In the embodiment illustrated, ring magnet 60 is mounted adjacent the rearward end of housing 40 and the rearward ends of blades 30 are at a substantial lever arm distance from the pivot ends 32 of the blades.

Advantages may be realized by arranging a magnetic force to be applied at the approximately greatest available distance from the pivot point (also referred to as the pivot location) of the blade. This placement of the magnet allows the magnet to use a lever arm length of the blade to apply a greater attractive force to the blade in a retracted position with a minimum of magnetic strength, yet allows the applied magnetic attractive force to decrease relatively rapidly as the blade is spatially separated from the magnet during movement into a deployed position. For example, in the illustrated embodiment, the rearward placement of ring magnet 60 allows the ring magnet to use essentially the entire length of the blades 30 as a lever arm to hold blades 30 in a retracted position, yet the applied magnetic attractive force decreases relatively rapidly as the rearward ends of the blades 30 become spatially separated from ring magnet 60 when moving into a deployed position.

An adapter can be used for mounting an arrow to broadhead 10, for example, magnetic insert, can be mounted to broadhead 10. The forward end of the adapter receives broadhead 10 and the rearward portion of the insert receives arrow shaft 68 (see FIG. 7) in a nesting relationship, which helps minimize damage to arrow shaft 68. The insert can be magnetic and applies a magnetic attractive force upon blades 30 to urge them to remain in a retracted position. The insert may be arranged such that the outer diameter of the insert is substantially equal to the outer diameter of housing 40. Alternatively, an adapter may be disposed around the housing, having inner diameter which fits the outer diameter of the broadhead housing. Optionally, rearward portions of the blades may include a notched area to allow the rearward portions of the blades to form nests to accommodate an adapter with a diameter larger than the housing.

Broadhead 10 can be used in conjunction with other types of magnetic and nonmagnetic adapters for attaching broadhead 10 to an arrow shaft. In an alternate embodiment, an insert is magnetic and is mounted adjacent a rearward portion of the sliding shaft housing 40. The magnetic attraction of the insert can be localized near the deployable ends of cutting blades 30 and may be used in combination with neither, one, or both of a magnetic housing and a magnetic collar. The insert applies a magnetic attractive force upon blades 30 to urge them to remain in a retracted position.

Other example adapters that may be used in conjunction with magnetic expandable broadheads of the present invention include Armor Tough™ Inserts marketed and sold by Bear® Archery, and adapters described in co-pending U.S. application Ser. No. 12/209,676, filed Sep. 12, 2008.

In certain embodiments, only housing 40 is magnetic, only collar 50 is magnetic, only a ring magnet 60 is magnetic, only an adapter is magnetic or alternately more than one of a magnetic housing, a magnetic collar, a ring magnet or an adapter may be used together. In further embodiments, other magnetic arrangements can be used, for example one or more magnet pieces may be inset into housing 40 to supply magnetic force only in selected areas, such as corresponding to retracted blade positions. In still other embodiments, the cutting blades can be magnetic or include portions that are magnetic.

Figure 7:
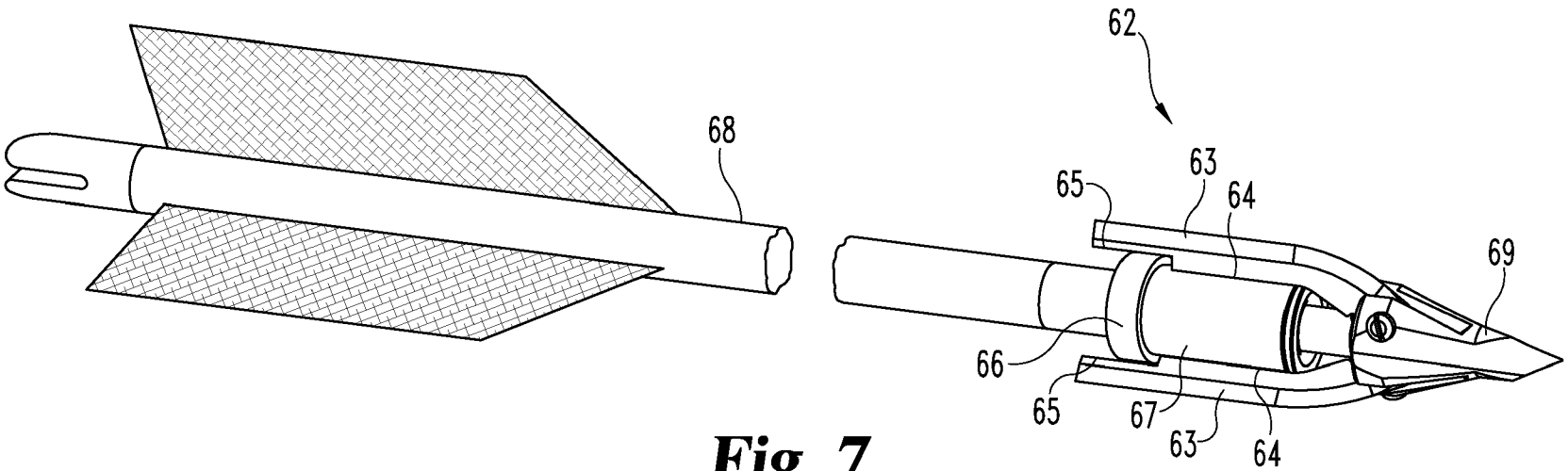
FIG. 7 is a perspective view of a broadhead attached to an arrow according to yet another embodiment of the present disclosure.

Depicted in FIG. 7 is a broadhead arrowhead 62 attached to an arrow shaft 68 according to another embodiment. Broadhead arrowhead 62 includes housing 67 and cutting blades 63, which are pivotally attached to tip 69. A ring magnet 66 is positioned adjacent the rear portion of housing 67 and the diameter of ring magnet 66 is larger than the diameter of the housing 67. To accommodate the larger diameter of ring magnet 66, the inner surfaces 64 of cutting blades 63 include larger diameter portions 65, which can take the form of, for example, slots, recessed portions and cut-away portions.

Figure 8:
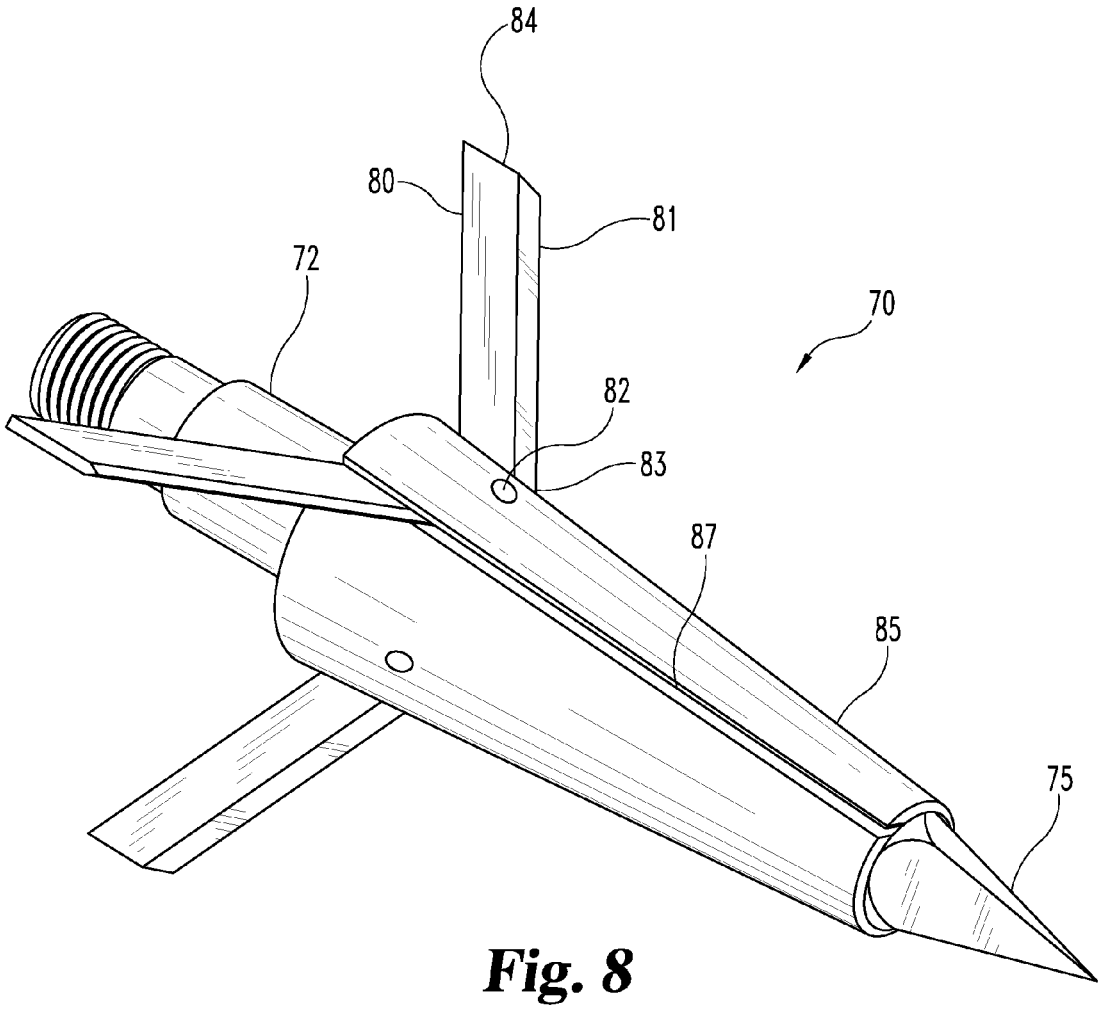
FIG. 8 is a perspective view of a broadhead according to still another embodiment of the present disclosure.
Figure 9:
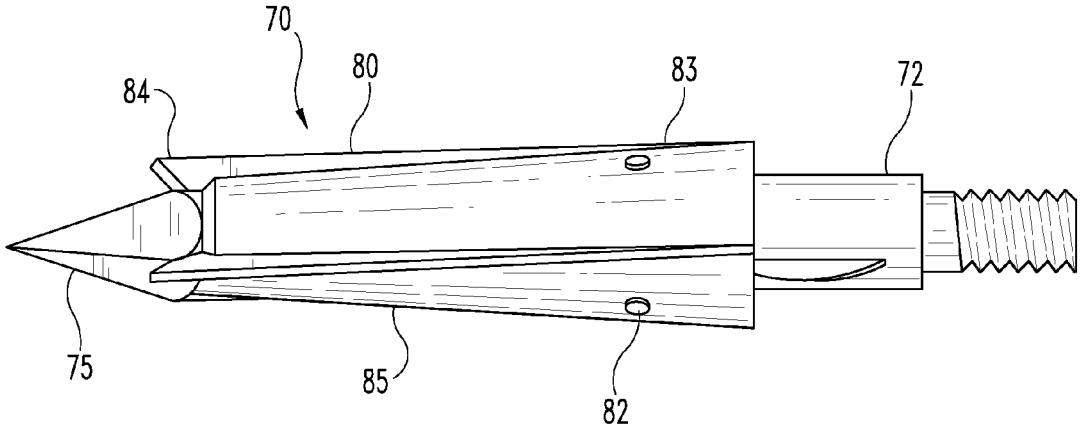
FIG. 9 is a side elevational view of the broadhead depicted in FIG. 8.

FIGS. 8 and 9 illustrate a broadhead arrowhead 70 according to another embodiment of the present invention includes a pointed tip adapted to penetrate a target and a rearward end adapted to attach to an arrow. A housing and tip are securely held together, such as by a threaded screw connection. The cutting blades are pivotally connected to the housing pivot pins. The housing includes channels which receive the cutting blades. In the deployed position (see FIG. 8), the pivoting ends of the cutting blades are received within the channels. In the retracted position (see FIG. 9), the length of the cutting blades from the pivoting ends to the deployable ends are received within the channels.

In the further embodiment, tip portion is magnetic and magnetically holds the cutting blades in the retracted position during launch and flight. Upon impact with the target, the force exerted by the target on the cutting blades overcomes the magnetic force holding the cutting blades in the retracted position and rotates the cutting blades from the retracted position depicted in FIG. 9 to the deployed position depicted in FIG. 8 exposing the cutting edges.

In use, the user of the magnetic broadhead rotates the cutting blades (30 or 80) from the deployed position to the retracted position prior to launching the broadhead. Typically, although not necessarily, the user overcomes a force oriented to deploy the cutting blades (for example a spring force) in order to move the cutting blades from the deployed position to the retracted position. The magnetic attraction between the magnetic portion (60 or 75) holds the cutting blades (30 or 80) in the retracted position during launch and flight of the broadhead. Upon impact with the target, the magnetic force holding the cutting blades in the retracted position is overcome by the extending force on the cutting blades, which is oriented to move the cutting blades from their retracted positions to their deployed positions.

After removing the broadhead from the target (and optionally clearing debris from the broadhead), the user need only move the cutting blades from the deployed position to the retracted position to ready the broadhead for launch (or storage, if desired). There is no need for the user to hold the cutting blades in the retracted position while positioning an elastic band or other type of restraining device on the cutting blades to hold them in the retracted position as required with other broadheads, greatly simplifying use of the expandable broadhead over previous expandable broadheads.

Although tip portion 75 is magnetic in the illustrated embodiment, alternate embodiments include a non-magnetic tip and magnetic portions that are part of housing 85 or are located within housing 85 to provide the magnetic attraction that holds blades 80 in the retracted position during launch and flight and allows blades 80 to overcome the magnetic attraction and deploy as the broadhead enters the target.

Although the magnetic portions of the broadhead arrowheads are described as being attached to and stationary with respect to the arrowhead housing, alternate embodiments include magnetic portions that are moveable with respect to the arrowhead housing. For example, certain embodiments include magnetic portions adapted to move rearwardly past the rearward ends of the cutting blades to decrease the magnetic attraction between the magnetic portion and the cutting blade when the broadhead arrowhead impacts a target.

While illustrated examples, representative embodiments and specific forms of the invention have been illustrated and described in detail in the drawings and foregoing description, the same is to be considered as illustrative and not restrictive or limiting. Any of the foregoing aspects of the present invention may be used in combination with other features, whether or not explicitly described as such. Dimensions, whether used explicitly or implicitly, are not intended to be limiting and may be altered as would be understood by one of ordinary skill in the art. Only exemplary embodiments have been shown and described, and all changes and modifications that come within the spirit of the invention are desired to be protected.

What is claimed is:

1. A broadhead arrowhead, comprising:

a broadhead body adapted to attach to an arrow shaft, at least a portion of the broadhead body being magnetic wherein the magnetic portion of the broadhead body forms an elongated cylinder; and cutting blades adapted to attach to an arrow shaft and having retracted positions with the cutting blades extending along the broadhead body and deployed positions with the cutting blades extending outward from the broadhead body;

wherein the magnetic portion of the broadhead body magnetically attracts and holds the blades in the retracted position during launch and flight; and wherein the cutting blades are adapted to overcome the magnetic attraction of the magnetic portion upon impact with a target and deploy from the retracted position to the deployed position upon impact with a target.

2. The broadhead arrowhead of claim 1, wherein each cutting blade includes a deployable end that extends outwardly when the broadhead impacts a target, and wherein the magnetic portion is adjacent the deployable ends of the cutting blades when the cutting blades are in the retracted position.

3. The broadhead arrowhead of claim 2, wherein the length of the magnetic portion along an axis substantially parallel to the arrow shaft is substantially less than the length of the cutting blades along the axis substantially parallel to the arrow shaft when the cutting blades are in the retracted position.

4. The broadhead arrowhead of claim 1, wherein each cutting blade includes a pivoting end around which the cutting blade rotates when the broadhead arrowhead impacts a target, and wherein the magnetic portion is adjacent the pivoting ends of the cutting blades.

5. The broadhead arrowhead of claim 4, wherein the length of the magnetic portion along an axis substantially parallel to the arrow shaft is substantially less than the length of the cutting blades along the axis substantially parallel to the arrow shaft when the cutting blades are in the retracted position.

6. The broadhead arrowhead of claim 1, wherein the broadhead body is cylindrical and the magnetic portion forms a ring magnet adjacent the rear portion of the cylinder.

7. The broadhead arrowhead of claim 1, wherein the broadhead body is cylindrical and the magnetic portion forms a ring magnet adjacent the forward portion of the cylinder.

8. The broadhead arrowhead of claim 1, wherein the inner surfaces of the cutting blades include larger diameter portions adapted to receive the magnetic portion of the broadhead body when the cutting blades are in the retracted position.

9. The broadhead arrowhead of claim 1, wherein the cutting blades are elongated, each cutting blade having a pivoting end pivotally attached to the shaft and a deployable end, and wherein the magnetic portion is localized near the deployable ends of the cutting blades when the cutting blades are in the retracted position.

10. The broadhead arrowhead of claim 1, comprising:

a pointed tip connected to the broadhead body and adapted to penetrate a target, wherein the cutting blades extend from the pivot location rearward from the pointed tip while the cutting blades are in the retracted position.

11. The arrowhead of claim 1, wherein the cutting blades have deployable ends arranged rearward of the pivoting ends while the blades are in the retracted position.

12. A method, comprising:

magnetically holding cutting blades of a broadhead arrowhead in a retracted position during launch and flight of the arrowhead;

overcoming the magnetic attraction holding the blades in the retracted position when the arrowhead impacts a target; and deploying the blades outwardly from the retracted position to a deployed position when the arrowhead impacts the target by rotating deployable ends of the cutting blades around pivoting ends of the cutting blades, the pivoting ends being pivotally attached to the broadhead arrowhead; and wherein the deployable ends of the cutting blades are rearward of the pivoting ends while the blades are in a retracted position.

13. The method of claim 12, comprising:

applying a force to the blades that overcomes the magnetic attraction holding the blades in the retracted position when the arrowhead impacts the target.

14. The method of claim 12, comprising:

positioning a magnetic portion adjacent the deployable ends of the cutting blades, the magnetic portion having a length along the flight direction that is substantially less than the length of the cutting blades along the flight direction while the blades are in the retracted position.

15. The method of claim 12, wherein the magnetic attraction holding the blades in a retracted position is provided by a ring magnet abutting the cutting blades.

16. A broadhead arrowhead assembly, comprising:

elongated cutting blades;

a central body connected to the elongated cutting blades, wherein each elongated cutting blade includes a deployable end adapted to extend outwardly from the central body when the arrowhead impacts a target; and a magnetic portion of said central body is localized near the deployable ends of the elongated cutting blades when the elongated cutting blades are in the retracted position;

wherein the elongated cutting blades and the magnetic portion are adapted to attach to an arrow shaft;

wherein the magnetic portion magnetically holds the elongated cutting blades in a retracted position during launch and flight, the elongated cutting blades being oriented substantially parallel to the arrow shaft to which the arrowhead is attached when in the retracted position; and wherein impact of the broadhead arrowhead on a target activates a mechanism that opens the blades from the retracted position to a deployed position with the blades extending outwardly in a substantially nonparallel direction to the arrow shaft.

17. The broadhead arrowhead assembly of claim 16, wherein the magnetic portion is part of a central body connected to the elongated cutting blades and the elongated cutting blades are adapted to extend outwardly from the central body when the arrowhead impacts a target.

18. The broadhead arrowhead assembly of claim 16, wherein the magnetic portion extends along a substantial portion of the length of the elongated cutting blades when the elongated cutting blades are in the retracted position.

19. The assembly of claim 16, wherein the magnetic portion forms a ring magnet abutting the cutting blades.

20. The assembly of claim 16, wherein the deployable ends of the cutting blades are rearward of the pivoting ends while the blades are in a retracted position.

* * * * *